US005921901A

United States Patent [19]

Palacios

[11] Patent Number: 5,921,901

[45] Date of Patent: Jul. 13, 1999

[54] UNIVERSAL ABDOMINAL MUSCLE EXERCISE APPARATUS

[76] Inventor: Nestor J. Palacios, P.O. Box 1025, Millbrook, N.Y. 12545

[21] Appl. No.: 09/033,492

[22] Filed: Mar. 2, 1998

[51] Int. Cl.[6] ..... A63B 21/04; A63B 21/00

[52] U.S. Cl. ..... 482/132; 482/135; 482/131; 482/907; 482/142

[58] Field of Search ..... 482/142, 130, 482/131, 114, 128, 129, 907, 148, 110, 53, 56, 132, 133, 134, 135, 139, 68, 51

[56] References Cited

U.S. PATENT DOCUMENTS

| | | | |
|---|---|---|---|
| 1,824,920 | 9/1931 | Novak . | |
| 1,984,165 | 12/1934 | Tolchin . | |
| 3,101,944 | 8/1963 | Cencig . | |
| 3,572,701 | 3/1971 | Agamian . | |
| 3,589,720 | 6/1971 | Agamian . | |
| 3,752,475 | 8/1973 | Ott . | |
| 3,797,824 | 3/1974 | Osbourne . | |
| 4,136,867 | 1/1979 | Wilkin . | |
| 4,930,769 | 6/1990 | Nenoff . | |
| 5,110,122 | 5/1992 | Moore | 482/134 |
| 5,295,935 | 3/1994 | Wang | 482/130 |
| 5,499,955 | 3/1996 | Becker | 482/66 X |
| 5,499,961 | 3/1996 | Mattox . | |
| 5,518,483 | 5/1996 | Oswald . | |
| 5,643,162 | 7/1997 | Landers | 482/131 |

*Primary Examiner*—Richard J. Apley
*Assistant Examiner*—William LaMarca
*Attorney, Agent, or Firm*—Robert W.J. Usher

[57] ABSTRACT

An exercise apparatus of a push-pull type for exercising a person's abdominal muscles includes a track unit formed by a track board having an upper, body supporting surface extending between front and rear ends; an elongate, track-supporting base board for extending horizontally across a floor; a knee support on the base board adjacent the rear end of the track board; and, a support member for supporting the track board pivotally connected to overlie the base board with the rear end adjacent the base board and the front end at selected elevations. A hand-grip carriage unit with a pair of hand grips and an elbow support aligned rearward of the hand-grips is removably mounted by rollers on the body supporting surface for reciprocal rolling movement therealong. An anchoring unit for a person's legs or hands, alternatively, can be releasably mounted to the front end of the track board, when elevated.

8 Claims, 3 Drawing Sheets

UNIVERSAL ABDOMINAL MUSCLE EXERCISE APPARATUS

FIELD OF THE INVENTION

The invention relates to apparatus for exercising a person's abdominal muscle group, in particular, to universal abdominal muscle exercise apparatus permitting a variety of exercises and, further to a hand-grip carriage unit for exercising the abdominal muscles.

BACKGROUND OF THE INVENTION

The benefits of "isometric" abdominal muscle training are well recognized. In a well known approach, a highly trained athlete manually reciprocates a simple abdominal roller or wheel across a floor surface by kneeling and extending and retracting his body.

However, not only does a relatively untrained person usually not have the initial strength, particularly in the wrists and lower back, to perform such exercise, but the exercise involves the same repetitive action whereas the most effective way to train a muscle group for continual improvement is to perform a variety of different exercises.

U.S. Pat. No. 4,930,769 issued in 1990 to Nenoff teaches an exercise apparatus providing a seat on a track along which a user advances his body by only a pull/push arm action while supported by the seat. The inclination of the track can be changed to alter the effort required. However, this apparatus is intended, primarily, to exercise muscles of the arms and back.

U.S. Pat. No. 5,499,961 issued 1996 to Mattox and U.S. Pat. No. 5,518,483 issued 1996 to Oswald both teach exercise apparatus of the push-pull type for exercising the abdominal muscle set in which the user manually reciprocates a hand grip device along a track by extending and retracting his body between kneeling and prone positions while resting his knees on a knee support.

However, although teaching variable resistance means, the latter two references do not teach means for reducing the effort of the user particularly ameliorating stress on the wrists and lower back. Furthermore, the exercise permitted by the apparatus still involves essentially the same repetitive movement.

SUMMARY OF THE INVENTION

It is an object of the invention to provide an exercise apparatus of the push-pull type for exercising, primarily, an individual's abdominal muscles and which can be used by both highly trained and less advanced individuals without requiring adjustment and is also readily adjustable for use by most individuals even though completely untrained.

It is a further object of the invention to provide a universal exercise apparatus which can be readily reconfigured to enable the performance of a variety of exercises both "isometric" and "concentric and eccentric" to train, primarily, the abdominal muscle group.

It is another object of the invention to provide an exercise apparatus which is of relatively simple construction and which can be manufactured at relatively low cost.

It is an additional object of the invention to provide an exercise apparatus which can be stored in compact condition and which can be readily assembled for use.

It is also an object of the invention to provide an exercise apparatus which can be easily transported by an individual from room to room.

According to one aspect, the invention provides an exercise apparatus of a push-pull type for exercising a person's abdominal muscles comprising an elongate track unit comprising a track for extending across a floor and having a front end, a rear end and, a knee support mounted adjacent the rear end; and a hand-grip carriage unit mountable on the track for reciprocal movement therealong so that a user kneeling on the knee support and gripping a hand-grip can perform a push-pull action to reciprocate the carriage between advanced and retracted positions adjacent the front end and the rear end, respectively, the improvement residing in that the hand-grip carriage unit comprises an elbow support located rearward of a hand grip so that a user can optionally support his elbows on the elbow support while gripping the hand-grip during the reciprocal movement to reduce effort required for the push-pull action, particularly reducing stress on the wrists and lower back.

Thus, the provision of the elbow support enables a less advanced individual to use apparatus to exercise the abdominal muscles.

Preferably, the track unit further comprises support means for supporting the track longitudinally inclined with the front end at selected elevations thereby to alter effort required for the push-pull action, enabling even completely untrained individuals to exercise the abdominal muscles.

In one, relatively simple and inexpensive construction, the track comprises an elongate, wooden, track board having an upper, body supporting surface and the track unit further includes a stand comprising an elongate, wooden, track supporting base board for extending horizontally across a floor and underlying the track in supporting relation thereto. The track board is hingedly connected to the base board at a location adjacent the knee support to permit inclination of the track.

It is further preferred that the apparatus comprise an anchoring unit for anchoring a person's legs and hands, alternatively, and releasable means for mounting the anchoring unit on the front end of the track, when elevated, the hand-grip carriage unit being removably mountable on the track so that when the hand-grip carriage unit is dismounted from the track, a user can lie, face up, on the body supporting surface of the track board and perform stomach muscle exercises of the "concentric" and "eccentric" variety by anchoring his legs or hands on the anchoring unit.

The use of the hand or leg anchoring unit attachment enables a variety of abdominal muscle exercises to be performed, both "isometric" and concentric and eccentric" so that the apparatus has a universal quality.

The means for removably mounting the hand-grip carriage unit on the track may comprise a plurality of wheels on the lower face for rolling along the body supporting surface and a pair of track engaging guide rails releasably secured to the lower face outside, and depending below, the wheels for engaging respective opposite longitudinal edges of the track board and so that removal of the guide rails permits the hand-grip carriage unit to be used on a floor surface.

According to another aspect, the invention includes the hand grip carriage unit per se use of which may enable the less trained individual to exercise without incurring the expense of the track unit.

BRIEF DESCRIPTION OF THE DRAWINGS

A specific embodiment of the invention according will now be described by way of example only with reference to the accompanying drawings in which.

DESCRIPTION OF PARTICULAR EMBODIMENT

Figure 1:
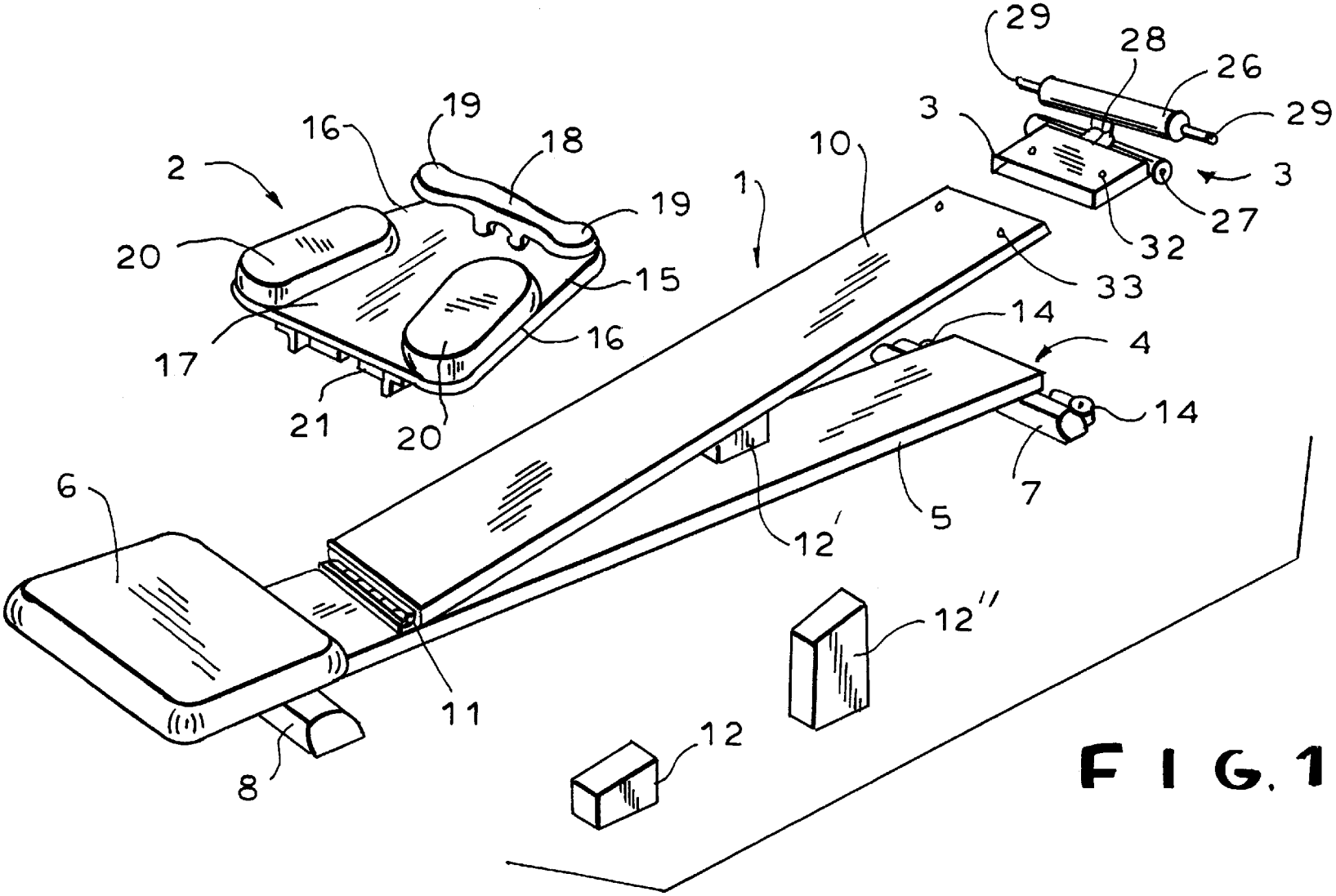
FIG. 1 is a schematic, perspective view of the exercise apparatus.

As shown in FIG. 1, the exercise apparatus comprises a track unit 1, a hand-grip carriage unit 2 and an anchoring unit 3 for hands or legs, for alternative mounting on the track unit.

The track unit 1 comprises a stand 4 comprising an elongate, wooden track-supporting base board 5 carrying a padded knee support 6 at a rear end and supported on respective transverse wooden feet 7, 8 at front and rear ends, respectively, and an elongate, wooden track board 10 pivotally connected to the base board by a piano hinge 11 at a location adjacent the knee support 6 to permit selective longitudinal inclination of the track board. A set of props 12', 12" and 12'" of different heights are provided for insertion of a selected prop between the lower face of the track board 10 and the upper face of the base board 5 to maintain the track board at a desired inclination. A pair of castors 14 are secured to the feet 7 so that a user may easily roll the track unit across a floor with rear end raised.

Figure 2:
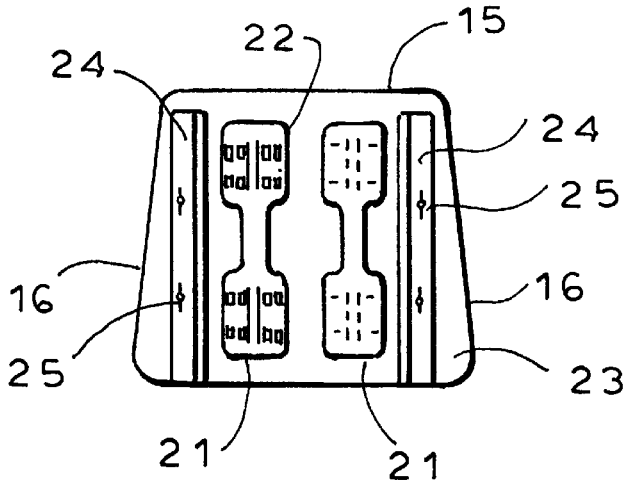
FIG. 2 is an underplan view of a hand grip carriage of the exercise apparatus.

The carriage unit 2 comprises a platform frame 15 having opposite longitudinal side edges 16 which taper toward a front end and an upper face 17 from a front end of which a T-handlebar 18 upstands providing a pair of hand grips 19 behind which a pair of elbow supports 20 are mounted in rearward alignment. As shown more clearly in FIG. 2, a pair of caged roller sets 21, (similar to those commonly used for moving refrigerators), with rollers 22 are mounted on the lower face 23 and identical L-section metal guide rails 24 are releasably secured by wing nuts 25 to the lower face 23 between the roller sets 21 and the longitudinal side edges 16 so that they depend below the rollers for sliding engagement with respective opposite longitudinal edges of the track board maintaining the carriage unit on the track board throughout sliding movement therealong.

The hand or leg anchoring unit 3 comprises an upper and lower padded transverse, bars 26 and 27, respectively, for extending under a knee and over an ankle of a user, respectively, and connected by a vertical bar 28 to extend side by side, in parallel relation, with a pair of exposed hand grip portions 29 extending from opposite axial ends of the upper padded bar 26, and having means for releasable attachment to various exercise apparatus, as generally known from the prior art. In the embodiment of the present invention, the means for releasable attachment has the novel form of a socket housing 31 of rectangular section for mating receipt of the front end of the track board and through apertures 32, 33 are bored in the walls of the socket housing and front end of the track board at aligned locations for receipt of removable locking pins (not shown) releasably to secure the housing 31 on the track board 10.

Figure 3:
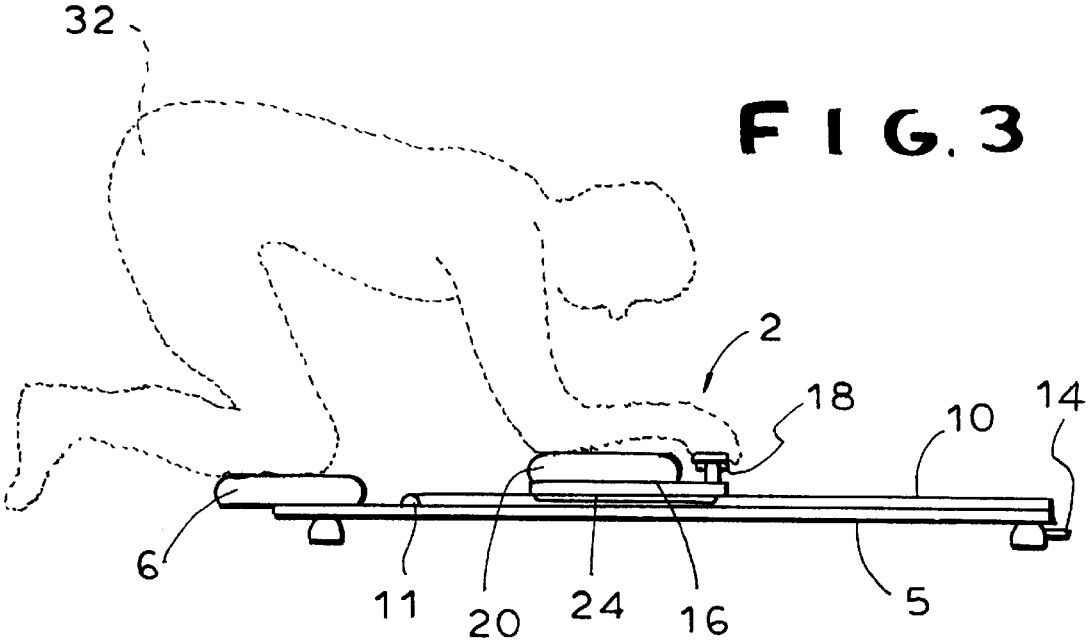
FIG. 3 is a schematic side elevation view of the exercise apparatus with the hand grip carriage in a fully withdrawn starting position on a horizontal track; and, FIG. 4 is a similar view to FIG. 3 but with the hand grip carriage fully extended; and, FIGS. 5, 6 and 7 are diagrammatic perspective views illustrating various exercises performed with a modified anchoring unit for anchoring a person's legs and hands, alternatively, installed.
Figure 4:
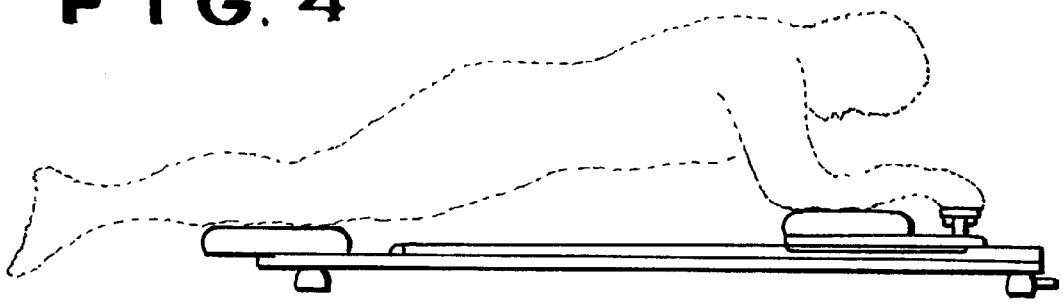

In one mode of operation shown in FIGS. 3 and 4, the carriage unit 2 is mounted on the track board so that a untrained user 32 can, in crouched position, kneeling on the padded knee support 6 and gripping the hand grips 19 perform a push-pull action, extending and retracting his body to reciprocate the carriage 2 along the body supporting surface while supporting his elbows on the elbow support 20 to reduce effort required, ameliorating the usual strain on the lower back and wrists. Increasing the inclination of the board using the props will also reduce the effort so that even an untrained person can perform the exercise without strain and the inclination of the track board progressively decreased with practice to progressively increase the effort required. A highly trained user will rely only on the hand grips for support during the exercise, as shown in the patent to Oswald, referred to above.

Figure 5:
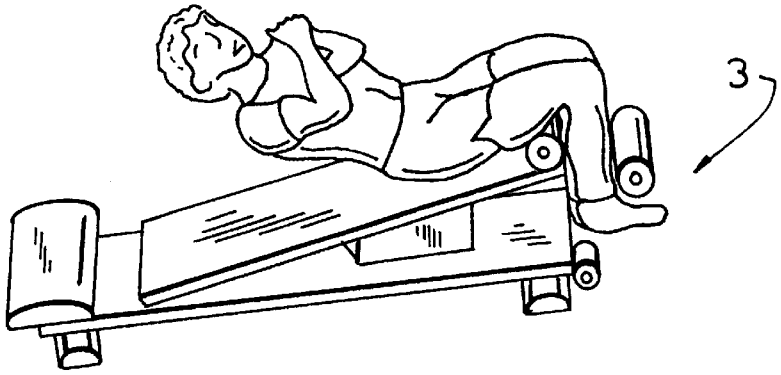
Figure 6:
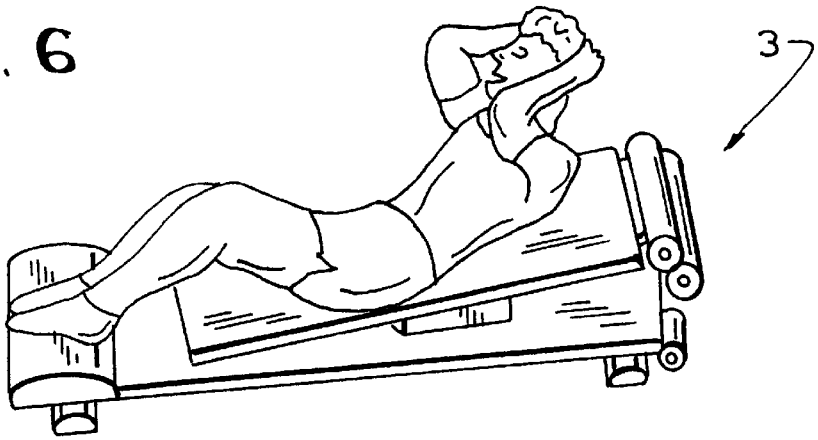
Figure 7:
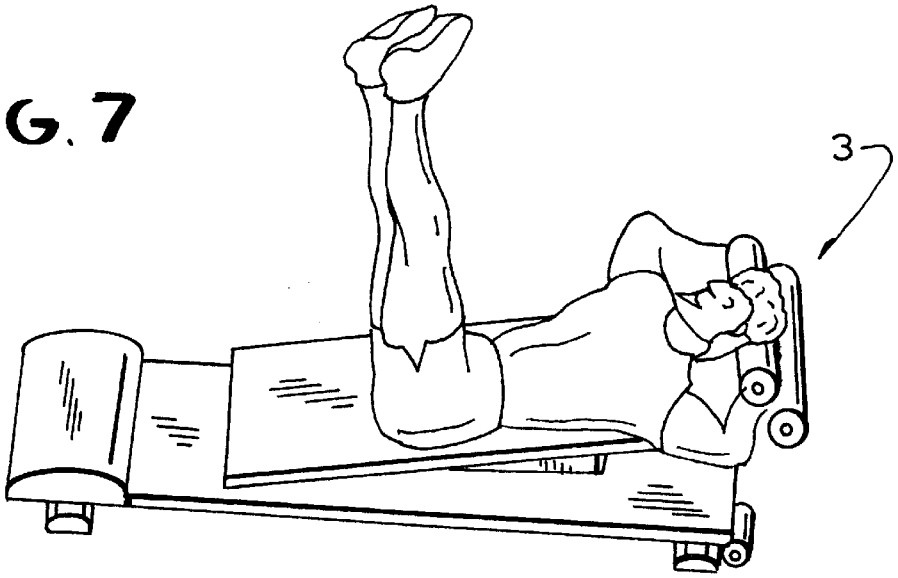

In an alternative mode of operation, illustrated in FIGS. 5, 6 and 7. the carriage unit has been removed from the track board by simply lifting thereoff and the hand or leg anchoring unit is attached to a suitably elevated front end enabling a variety of different exercises to be performed.

FIG. 5 illustrates use of the modified hand or leg anchoring unit attachment, (without exposed hand grips), with the legs anchored therein and body extending down the inclined track for the performance of advanced/difficult sit-ups. FIG. 6 illustrates use of the track inclination to perform sit-ups more easily with the hands anchored on the anchoring unit. FIG. 7 illustrates an alternative use of the hand or leg anchoring unit as a hand grip to perform leg curls.

In a modification, a central area of the body supporting surface of the track board may be thinly padded and the carriage wheels located on adjacent edges of the carriage so as to run along the longitudinal edges of the track board avoiding interference with the padding.

The track board may be maintained at a selected inclination by employing a single prop pivotally attached thereto and adjustable between alternative positions corresponding to different inclinations of the track board.

The track board may protrude beyond the base board at the front end so that, a leg or arm anchoring unit (not shown), having only a single bar can be attached thereto even when the track board is substantially horizontal.

I claim:

1. An exercise apparatus of a push-pull type for exercising a person's abdominal muscles comprising an elongate track unit comprising a track for extending across a floor and having a front end, a rear end and, a knee support mounted adjacent the rear end; and a hand-grip carriage unit mountable on the track for reciprocal movement therealong so that a user kneeling on the knee support and gripping a hand-grip can perform a push-pull action to reciprocate the carriage between advanced and retracted positions adjacent the front end and the rear end, respectively, the improvement residing in that the hand-grip carriage unit comprises a support configured for receiving a user's elbow or forearm and located rearward of a hand grip so that a user can optionally support his elbows or forearms on the support while gripping the hand-grip during the reciprocal movement to reduce effort required for the push-pull action.

2. An apparatus according to claim 1, wherein the track unit further comprises support means for supporting the track longitudinally inclined with the front end at selected elevations thereby to alter effort required for the push-pull action.

3. An apparatus according to claim 2, wherein the track comprises an elongate, wooden, track board having an upper, body supporting surface and the track unit further includes a stand comprising an elongate, wooden, track supporting base board for extending horizontally across a floor and underlying the track in supporting relation thereto.

4. An apparatus according to claim 3, wherein the track board is hingedly connected to the base board at a location adjacent the knee support to permit inclination of the track.

5. An apparatus according to claim 2, further comprising an anchoring units for anchoring a person's legs and hands, alternatively, and releasable means for mounting the anchoring unit on the front end of the track, when elevated, the hand-grip carriage unit being removably mountable on the track so that when the hand-grip carriage unit is dismounted from the track, a user can lie, face up, on the body supporting surface of the track board and perform stomach muscle exercises by anchoring his legs and hands, alternatively, on the anchoring unit.

6. An exercise apparatus of a push-pull type for exercising a person's abdominal muscles comprising:

a track unit comprising:

a track having a front end and a rear end, and an upper, body supporting surface extending between the ends;

an elongate, track-supporting stand for extending horizontally across a floor;

a knee support on the stand adjacent the rear end of the track; and, support means for supporting the track overlying the stand at selected longitudinal inclinations, with the rear end adjacent the stand and the front end at selected elevations;

a hand-grip carriage unit comprising an upper face and a lower face, a pair of hand grips upstanding from the upper face and a support configured for receiving a user's elbow or forearm on the upper face, aligned rearward of the hand-grips, means on the lower face for removably mounting the carriage on the body supporting surface of the track for reciprocal movement therealong; and an anchoring unit for anchoring a person's legs and hands, alternatively, and releasable attachment means on the front end of the track and on the anchoring unit cooperable to removably mount the anchoring unit on the front end of the track, when elevated, so that when the anchoring unit is dismounted from the track and the hand-grip carriage unit is mounted on the track, a user kneeling on the knee support, gripping the hand-grips and optionally supporting his elbows the forearms support can perform a push-pull action to reciprocate the carriage between advanced and retracted positions adjacent the front end and rear end of the track, respectively, and when the hand-grip carriage unit is dismounted from the track and the anchoring unit is mounted on the front end of the track, a user can lie, face up, on the body supporting surface of the track board with his head adjacent the stand by anchoring his legs and hands, alternatively, on the anchoring unit, and perform stomach muscle exercises.

7. An apparatus according to claim 6 wherein the track and the stand comprise a wooden track board and a wooden base board, respectively, the track board being hingedly connected to the base board at a location adjacent the knee support to permit inclination of the track.

8. An apparatus according to claim 7 wherein the means for removably mounting the hand-grip carriage unit on the track comprise a plurality of wheels on the lower face for rolling along the body supporting surface and a pair of track engaging guide rails releasably secured to the lower face outside, and depending below, the wheels for engaging respective opposite longitudinal edges of the track board so that removal of the guide rails permits the hand-grip carriage unit to be used on a floor surface.

* * * * *